United States Patent [19]

Poweleit

[11] Patent Number: 4,896,020

[45] Date of Patent: Jan. 23, 1990

[54] PORTABLE ELECTRIC HAIR DRYER

[75] Inventor: Hans-Dieter Poweleit, Haan, Fed. Rep. of Germany

[73] Assignee: Robert Krups Stiftung & Co. KG., Solingen, Fed. Rep. of Germany

[21] Appl. No.: 301,541

[22] Filed: Jan. 24, 1989

[30] Foreign Application Priority Data

Jan. 29, 1988 [DE] Fed. Rep. of Germany ..... 3802638

[51] Int. Cl.[4] ..... H05B 3/02; F24H 3/04; A45D 20/08

[52] U.S. Cl. ..... 219/370; 34/97

[58] Field of Search ..... 34/96–101; 219/364, 370, 374, 375, 366, 367, 369, 373, 379

[56] References Cited

U.S. PATENT DOCUMENTS

| | | | |
|---|---|---|---|
| 4,309,595 | 1/1982 | Long et al. | 219/375 |
| 4,647,757 | 3/1987 | Haastrup | 219/375 |
| 4,767,914 | 8/1988 | Glucksman | 219/364 |
| 4,769,572 | 9/1988 | Voigt | 310/68 D |
| 4,794,225 | 12/1988 | Maese | 219/374 |

FOREIGN PATENT DOCUMENTS

| | | | |
|---|---|---|---|
| 54-14858 | 2/1979 | Japan | 219/370 |
| 80/00783 | 5/1980 | PCT Int'l Appl. | 219/370 |

*Primary Examiner*—Derek S. Jennings
*Assistant Examiner*—Geoffrey S. Evans
*Attorney, Agent, or Firm*—Peter K. Kontler

[57] ABSTRACT

A portable electric hair dryer wherein the insulating carrier of electric contacts for a motor which drives an air impeller between the air-admitting inlet and the air-discharging outlet of the housing is separably coupled to a second insulating carrier which is provided with electric contacts for and supports an electric heater. The latter heats the flow of air between the inlet and the outlet of the housing. One of the carriers has male coupling elements, which can include or constitute the contacts on the one carrier, and the other carrier can have female coupling elements, which can include or constitute the contacts on the other carrier, capable of separably receiving and retaining the male coupling elements.

15 Claims, 3 Drawing Sheets

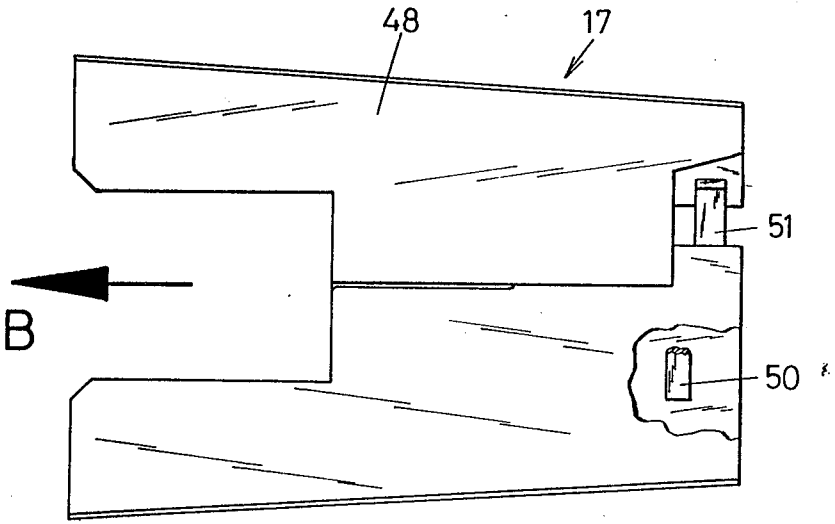
FIG. 2
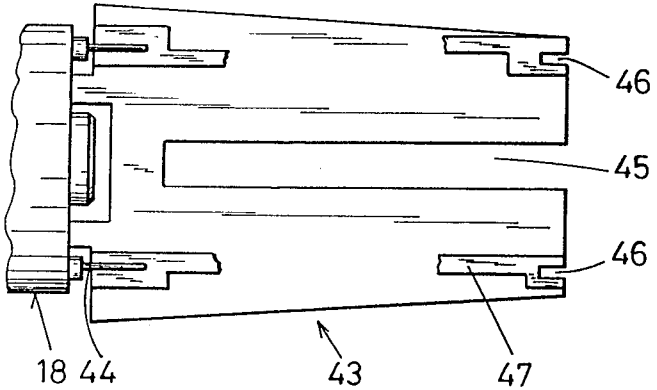

PORTABLE ELECTRIC HAIR DRYER

CROSS-REFERENCE TO RELATED CASES

The hair dryer of the present invention is similar to those disclosed in commonly owned copending patent application Ser. No. 171,480 filed Mar. 21, 1988 by Heinz-Jürgen Ohlsen for "Portable Hair Dryer", in commonly owned copending patent application Ser. No. 234,795 filed Aug. 22, 1988 by Hans-Dieter Poweleit and Heinrich Komesker for "Portable Electric Hair Dryer", and in commonly owned copending patent application Ser. No. 315,457 filed Feb. 23, 1989 by Heinz-Jürgen Ohlsen and Hans-Dieter Poweleit for "Electric Hair Dryer".

BACKGROUND OF THE INVENTION

The invention relates to hair dryers in general, and more particularly to improvements in portable electric hair dryers. Still more particularly, the invention relates to improvements in hair dryers of the type wherein a housing confines an electric motor which drives an impeller or another suitable rotor in order to induce a flow of air from an inlet of the housing, past an electric heater, and to an outlet of the housing.

It is known to provide a hair dryer of the above outlined character with a first insulating carrier for motor contacts, with a second insulating carrier for the electric contacts of a heater, and with permanent connections between the contacts of the two carriers. It is also known to use the carrier for heater contacts as a means for supporting the heater. Reference may be had to the aforementioned commonly owned copending patent applications. The helices of the heater are recessed into marginal notches of the respective carrier in such a way that the major portion of the heater is not contacted by any mechanical part and can readily exchange heat with the body of air which flows from the inlet to the outlet of the housing. The carrier of motor contacts is normally secured to the front end wall of the motor housing and extends into the interior of the heater. The carrier of motor contacts can further support one or more regulating and/or switching elements in the motor circuit.

It is presently customary to solder the contacts on one of the carriers with corresponding contacts on the other carrier. The soldering operation is time-consuming and contributes significantly to initial cost of the hair dryer. Moreover, such connections between the contacts on the two carriers establish a permanent bond between the carriers so that one of the carriers must be discarded if the other carrier is to be replaced. The bond is rather weak so that it cannot invariably ensure extraction of one of the carriers in response to extraction of the other carrier or vice versa.

OBJECTS OF THE INVENTION

An object of the invention is to provide an electric hair dryer, particularly a portable hair dryer, wherein the carriers of motor contacts and heater contacts are connected to each other in a novel and improved way.

Another object of the invention is to provide novel and improved insulating carriers for use in the above outlined hair dryer.

A further object of the invention is to provide novel and improved means for separably coupling the insulating carriers to each other.

An additional object of the invention is to provide novel and improved electric contacts for use with the above outlined carriers.

Still another object of the invention is to provide simple, compact and inexpensive means for electrically coupling to each other sets of contacts in the housing of a portable electric hair dryer.

A further object of the invention is to provide a hair dryer wherein discrete carriers of contacts can be installed or removed independently of each other.

SUMMARY OF THE INVENTION

The invention is embodied in an electric hair dryer, particularly in a portable hair dryer. The improved dryer comprises a hollow housing (e.g., in the form of an elongated tube) having an air-admitting inlet at one end and an air-discharging outlet at the other end (i.e., the outlet is remote from the inlet), means for inducing a flow of air through the housing from the inlet to the outlet including a rotor (such as an impeller) in the housing and an electric motor which serves to drive the rotor, a first insulating carrier which is provided with electric contacts for the motor, a second insulating carrier having electric contacts for the heater, and means for separably coupling the first and second carriers with each other so that the contacts of the first carrier engage the contacts of the second carrier.

The heater is preferably mounted directly on the second carrier, and the coupling means can include the contacts of one or both carriers.

In accordance with a presently preferred embodiment of the invention, the coupling means comprises one or more female coupling elements on one of the carriers, and one or more male coupling elements on the other carrier. Each male coupling element extends into one of the female coupling elements. Each female coupling element can include a slot in the one carrier, particularly in the carrier of contacts for the motor, and each male coupling element can include a lug on the other carrier.

The first carrier can include a plate made of insulating material and having a marginal portion provided with one or more slots, each such slot forming part of a female coupling element. Each lug can have a bent end portion which is received in the slot of the respective female coupling element. The lugs form part of contacts on the corresponding carrier.

The second carrier can include a plurality of (e.g., two) crossing plates, and the aforementioned lugs can constitute metallic strips, one on each of the crossing plates. Each strip has a first end portion which is connected with the heater and a second end portion which engages a contact on the first carrier. Thus, the second end portion of each lug can extend into a slot of the first carrier to thereby engage a strip conductor provided on the first carrier and forming part of or constituting a contact for the motor.

The carriers are preferably installed in the housing between the outlet and the motor, most preferably in such a way that the second carrier (for the contacts of the heater) is disposed between the first carrier and the outlet. The second carrier is preferably movable longitudinally of the housing to thereby disengage the coupling means and to simultaneously disengage the contacts for the heater from the contacts for the motor.

The novel features which are considered as characteristic of the invention are set forth in particular in the appended claims. The improved hair dryer itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged elevational view of the two carriers and of a portion of the motor, the carrier for the contacts of the heater being detached from the carrier of contacts for the motor and a portion of one plate of the carrier for the contacts of the heater being broken away;

DESCRIPTION OF PREFERRED EMBODIMENTS

Figure 1:
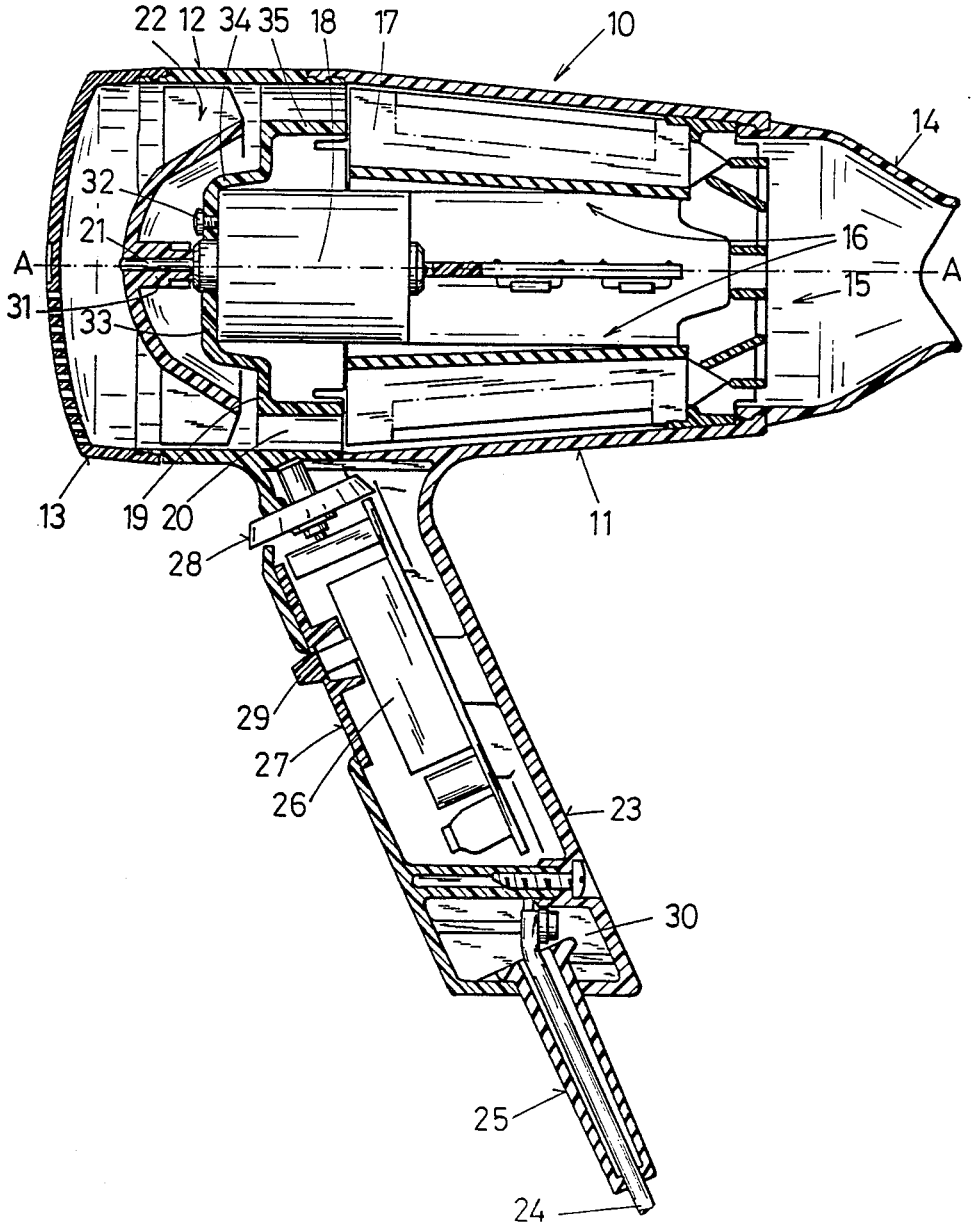
FIG. 1 is a somewhat schematic central sectional view of a portable electric hair dryer which embodies one form of the invention.

Referring first to FIG. 1, there is shown a portable electric hair dryer 10 which comprises a composite tubular housing having a front section 11 and a rear section 12. These sections can be made of a suitable lightweight insulating plastic material. The manner in which the sections 11 and 12 of the housing are separably coupled to each other is known and is not specifically shown in the drawing. FIGS. 1 to 5 merely show those component parts of the hair dryer 10 which are necessary for full understanding of the invention. For example, the drawing does not show all component parts of the electric circuits for an electric motor 18 and an electric heater 16. The non-illustrated parts can be constructed and assembled in a manner as disclosed in the aforementioned copending patent applications and/or in commercially available portable electric hair dryers of the assignee, for example, those known as "Turbo Pocket" (distributed by Robert Krups, North America, Allendale, N.J.).

The rear end of the housing section 12 has an inlet for admission of atmospheric air and carries a detachable screen 13 having a plurality of interstices for inflowing air and serving to prevent entry of solid particles. The screen 13 can be provided with two or more male and/or female detent elements (shown but not referenced in FIG. 1) which cooperate with complementary female and/or male detent elements on the housing section 12 to ensure the establishment of a reliable but preferably separable connection between the housing and the screen. In accordance with a presently preferred embodiment, the screen 13 is formed with several concentric annuli of arcuate interstices for inflowing atmospheric air.

The outlet at the front end of the housing section 11 contains a one-piece grate 15 behind a detachable air flow concentrating nozzle 14. The grate 15 is preferably made of a plastic material and can comprise an outer ring as well as one or more additional rings which are spaced apart from and are concentric with each other and with the outer ring. The rings are connected to each other by radially extending webs or ribs. Each intermediate ring of the grate 15 is disposed within a larger-diameter ring and surrounds a smaller-diameter ring. The illustrated grate 15 has four concentric rings, and at least one of these rings resembles a hollow conical frustum which tapers in a direction toward the interior of the nozzle 14, e.g., at an angle of approximately 25°. The common axis of the four rings forming part of the grate 15 preferably coincides with the axis A—A of the tubular housing including the sections 11 and 12.

The outermost ring of the grate 15 is recessed into the front end portion of the housing section 11 so as to provide room for insertion of the rear end portion of the nozzle 14. The latter can be provided with male and/or female detent elements which are engageable with complementary female and/or male detent elements of the section 11 to ensure that the user can rapidly attach the nozzle 14 to, or rapidly detach the nozzle from, the housing section 11 in front of the grate 15. The detent elements which separably couple the section 11 with the nozzle 14 are preferably integral parts of 11 and 14, i.e., they are formed at the time the section 11 and the nozzle 14 are made in suitable extruding, injection molding or other machines for the processing of plastic materials.

The grate 15 can be inserted into the front end of the section 11 before the section 11 is coupled to the section 12. The grate 15 is preferably provided with abutments for the front edge faces of two plate-like members 48 (see particularly FIGS. 2, 3 and 4) forming part of an insulating carrier 17 in the interior of the section 11. The aforementioned ribs or webs between the rings of the grate 15 can be formed with notches or otherwise configurated recesses for reception of front edges of the plate-like members 48 to thus ensure that the carrier 17 is maintained in a predetermined position in response to proper insertion into the section 11. The carrier 17 serves as a support for the electric heater 16 which raises the temperature of the flow of air between the inlet of the housing section 12 and the outlet of the housing section 11 so that the nozzle 14 can direct a column of hot air against the hair of the user. As can be seen in FIG. 1, the electric heater 16 is disposed substantially midway between the ends of the tubular housing including the sections 11 and 12.

The heater 16 is installed downstream of a diffusor or guide 20 having a substantially washer-like flat central portion 33 with a central opening for the output shaft 21 of the electric motor 18. One or more screws 32 or other suitable fasteners are provided to secure the motor 18 to the central portion 33 of the diffusor 20. The latter further comprises an inner tubular portion 34 which spacedly surrounds the rear section of the motor housing, second washer-like portion 19 which extends radially outwardly from the front end of the portion 34, and an outer tubular portion 35 which carries the guide vanes of the diffusor and extends forwardly from the radially outermost part of the disc-shaped portion 19. The portions 33 and 19 extend substantially at right angles to the common axis A—A of the housing sections 11, 12, and the axes of the tubular portions 34, 35 can coincide with the axis A—A.

The vanes of the diffusor 20 are offset with reference to the plate-like members 48 of the carrier 17 in the circumferential direction of the housing sections 11 and 12. This entails a rather pronounced agitation of air which flows into the range of the heater 16 to thus ensure that the temperature of air during flow between the members 48 of the carrier 17 does not exceed an acceptable value. Such control of temperatures in the region of the heater 16 is desirable and advantageous because it permits the use of a housing consisting of thin-walled sections made of an inexpensive plastic material. Moreover, it is not necessary to install heat barriers between the heater 16 and the internal surface of the housing section 11.

The exact construction of the electric motor 18 on the disc-shaped portion 33 of the diffusor 20 forms no part of the invention. The output shaft 21 of this motor drives a rotor 22 here shown as an impeller which serves to induce the flow of air from the atmosphere, through the screen 13, between the vanes of the diffusor 20, past the heater 16, through the grate 15 and into the nozzle 14. The impeller 22 has a hub 31 which surrounds the exposed portion of and is affixed to the output shaft 21.

The hair dryer 10 further comprises a hollow pistol grip handle 23 which can form an integral part of the housing section 11 and slopes forwardly so that it makes an acute angle with the common axis A—A of the sections 11 and 12. The interior of the handle 23 serves for confinement of several component parts of the hair dryer 10 including an electric on-off switch 26 having a knob-shaped actuator 29 which is accessible at the exterior of the handle 23. The actuator 29 forms part of a shield 27 which is reciprocable in a window in the rear wall of the handle 23. The extent of reciprocability of the shield 27 and actuator 29 relative to the window is limited by suitable guide means and stops for the shield 27 so that the latter can be shifted between at least two positions in one of which the switch 26 completes and in the other of which the switch interrupts the circuits of the motor 18 and heater 16. Two parallel marginal portions of the shield 27 can be provided with followers which are compelled to slide along rails or along other suitable guide elements at the inner side of the handle 23.

The handle 23 further accommodates a wheel-shaped regulator 28 which is closely adjacent the housing sections 11, 12 and a portion of which extends from the handle, so that it can be manipulated by the hand holding the handle, for the purpose of regulating the output of the hair dryer 10 by altering the speed of the motor 18 and/or the action of the heater 16.

The lower end portion of the handle 23 carries an outwardly extending tubular sheath 25 for an electric cable 24. The illustrated end portion of the cable 24 is secured to the handle 23 beneath the switch 26 by a conventional clamp 30 which prevents extraction of the cable, and the other end portion of the cable 24 carries a conventional plug (not shown) for insertion into a wall outlet or the like. The bare ends of conductors in the cable 24 are connected with the terminals of the switch 26 in a manner not forming part of the invention. This switch can be of any conventional design.

Two electric contacts 47 (see particularly FIGS. 2 and 3) are provided on an insulating carrier 43 which is or can be affixed to the front wall of the motor housing and has a centrally located elongated slot-shaped recess 45 for portions of the aforementioned plate-like members 48 which together form the carrier 17 of the heater 16 and its contacts 50, 51. The carrier 43 is a flat plate or panel which is made of an insulating material and extends in the direction of common axis A—A of the housing sections 11 and 12. The terminals 44 of the motor 18 are electrically connected with the adjacent end portions of strip-shaped conductors 47 which constitute the contacts on the carrier 43. The latter further supports one or more additional electrical or electronic components of the type employed in portable electric hair dryers but forming no part of the present invention.

The open end of the centrally located recess 45 is located in that (front) edge face of the carrier 43 which confronts the grate 15 when the carrier 43 is properly coupled to the carrier 17 and the two carriers are properly installed in the housing behind the grate 15. The recess 45 is flanked by two short slots 46 which are also provided in the aforementioned front edge face of the carrier 43 and can be said to form part of female coupling elements serving to separably couple the carrier 17 for the heater 16 with the carrier 43 of contacts 47 for the motor 18. The front end portions of the contacts 47 are immediately adjacent and can constitute liners for the respective slots 46 so that such contacts 47 also form part of means for separably coupling the carriers 17 and 43 to each other. The manner in which the strip-shaped conductors or contacts 47 are applied to the carrier 43 forms no part of the present invention. Such conductors or contacts can constitute prefabricated parts which are bonded to the carrier 43. Alternatively, the metallic material of the contacts 47 can be deposited directly on the respective portions of the carrier 43.

Figure 3:
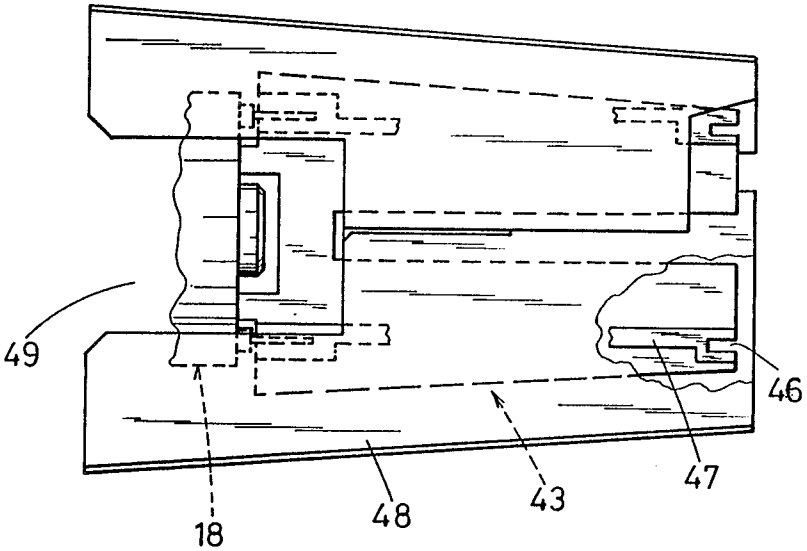
FIG. 3 shows the structure of FIG. 2 but with the two carriers separably coupled to each other.
Figure 4:
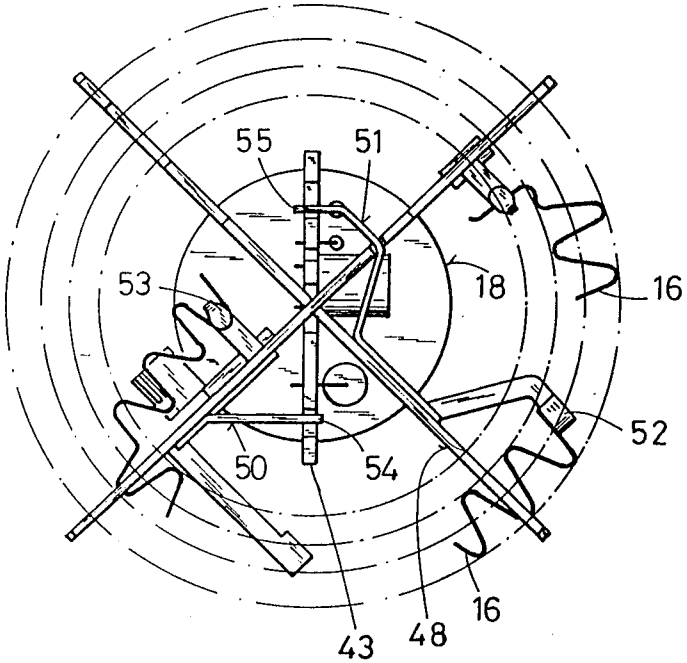
FIG. 4 is an end elevational view substantially as seen from the right-hand side of FIG. 3 and further showing portions of the heater.

The construction of the carrier 17 for the heater 16 and its lug-shaped contacts 50, 51 is shown in FIGS. 2 to 4. The plate-like members 48 of this carrier cross each other (see particularly FIG. 4) to define four chambers for portions of helices which constitute or form part of the electric heater 16. The members 48 are interdigitated and define a socket 49 for the front portion of the motor 18. The longitudinally extending marginal portions of the plate-like members 48 have notches (not specifically shown) for the helices of the heater 16. Portions of helices of the heater 16 are shown in FIG. 4.

The plate-like members 48 of the carrier 17 support the aforementioned contacts 50 and 51 for the heater 16. A portion of each such contact is secured to the respective member 48, e.g., by employing a hollow rivet. However, it is equally possible to provide the plate-like members 48 with holes for portions of the respective contacts 50, 51 and to bend and/or otherwise deform the contacts 50, 51 in order to ensure that they will remain in desired positions with reference to the plate-like members 48. For example, each of the contacts 50, 51 can comprise a tongue which extends through an opening of the respective plate-like member 48 and is bent for the purpose of remaining in the selected position. Those end portions of the contacts 50, 51 which are conductively connected with the helices of the heater 16 are shown at 52 and 53. For example, the end portions 52, 53 can be soldered to the heater 16. The other end portions 54, 55 of the contacts 50, 51 extend into the slots 46 of the carrier 43 when the latter is properly assembled with the plate-like members 48 of the carrier 17. The end portions 54, 55 can be said to constitute male coupling elements which releasably engage the adjacent female coupling elements including the slots 46 of the carrier 43 to establish a reliable but separable mechanical connection between the carriers 17, 43 as well as an electrical connection between the contacts 47 of the carrier 43 and the contacts 50, 51 of the carrier 17. It is presently preferred to make the contacts 50, 51 of a springy metallic material in order to ensure the establishment of a more reliable mechanical and electrical connection with the carrier 43 and contacts 47.

FIG. 2 shows that the carrier 17 (including its plate-like members 48) and the contacts 50, 51 are assembled into a prefabricated unit which can be coupled with the carrier 43 by moving it in the direction of arrow B. This prefabricated or preassembled unit further includes the electric heater 16 (not shown in FIG. 2 for the sake of clarity) which is soldered to the end portions 52, 53 of the contacts 50 and 51. The carrier 43 is already connected to the motor 18 by way of terminals 44 and the adjacent end portions of contacts 47 so that coupling of the plate-like members 48 to the carrier 43 completes assembly of the motor 18, heater 16 and carriers 17, 43 into a larger unit which is ready to be inserted into the housing including the sections 11 and 12. The end portions 54, 55 of the contacts 50, 51 automatically enter the respective slots 46 of the carrier 43 if the plate-like members 48 are properly oriented with reference to the carrier 43 during movement of carrier 17 in the direction of arrow B. The extent of frictional engagement between the end portions 54, 55 of contacts 50, 51 and the adjacent end portions of contacts 47 determines the magnitude of force which is required to couple the carriers 43, 17 to each other or to detach the carrier 17 from the carrier 43.

An important advantage of the improved hair dryer is that the parts 16, 17, 50, 51 can be assembled into a prefabricated self-sustaining unit which can be rapidly coupled to the carrier 43. Analogously, the parts 18, 22 and 43 can be assembled into a second prefabricated unit to even further simplify the assembly of the hair dryer 10. In addition, the contacts 50, 51 are certain to reliably engage the corresponding contacts 47 as soon as the carrier 17 is properly coupled to the carrier 43. There is no need to solder and/or otherwise permanently bond contacts on one of the insulating carriers to contacts on the other insulating carrier; this contributes significantly to lower cost of the appliance. The establishment of reliable electrical connections between the contacts on the carrier 43 and the corresponding contacts on the carrier 17 is ensured irrespective of the overall number of contacts, and such connections can be established and maintained for any desired period of time in spite of convenient separability of the carrier 17 from the carrier 43. All that is necessary to separate the carriers from each other is to pull the carrier 43 to the left and/or to pull the carrier 17 to the right, as seen in FIG. 3. Rapid separation of the carrier 17 from the carrier 3 is desirable and advantageous when the heater 16 necessitates inspection, repair or replacement.

Still another advantage of the improved hair dryer 10 is that the coupling which consists of separably connected male and female coupling elements is much more reliable (in spite of separability of the carriers 17 and 43) than a conventional quasi permanent coupling which is established by soldering the contacts on one of the carriers to corresponding contacts on the other carrier. It has been found that a coupling including the end portions 54, 55 of contacts 50, 51 on the carrier 17 and the slotted end portions of contacts 47 on the carrier 43 is capable of ensuring the establishment of a reliable mechanical connection as well as of a reliable electrical connection so that only the contacts 47 must be connected with the switch 26. The slots 46 in the carrier 43 can be formed at the time of making this carrier so that the making of female coupling elements does not necessitate a separate treatment in a machine tool or the like. The elasticity or springiness of metallic material of the contacts 50, 51 renders it possible to further enhance the reliability of mechanical and electrical connections between the two units by the simple expedient of inserting the end portions 54, 55 into the respective slots 46 in such a way that the end portions 54, 55 are maintained in stressed condition and bear against the adjacent end portions of the respective strip-shaped contacts 47.

The improved hair dryer is susceptible of many additional modifications. For example, the configuration of the carrier 43 and/or carrier 17 can depart from those shown in the drawing. This also applies for the configuration and/or dimensions of the contacts on the carrier 43 and/or of the contacts on the carrier 17. Still further, each carrier can be provided with three or more contacts, and each contact on one of the carriers is caused to automatically engage a contact on the other carrier when the carriers are properly coupled to each other. In addition, the configuration and/or other features of an electric hair dryer which embodies the invention can depart considerably from the configuration and/or other features of the illustrated hair dryer 10. The mechanical coupling means between the two carriers may but need not include or form part of the electric contacts on the carriers; all that counts is to ensure that the two carriers can be reliably but separably coupled to each other and that a required number of contacts on one of the carriers will be properly engaged by complementary contacts on the other carrier when the two carriers are properly coupled to one another.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An electric hair dryer, particularly a portable hair dryer, comprising a hollow housing having an air-admitting inlet and an air-discharging outlet spaced apart from said inlet; means for inducing a flow of air through said housing from said inlet to said outlet, including a rotor in said housing and an electric motor for said rotor; an electric heater for the flow of air in said housing; a first insulating carrier; electric contacts for said motor provided on said first carrier; a second insulating carrier; contacts for said heater provided on said second carrier; and means for separably coupling said carriers with each other so that the contacts for said motor engage the contacts for said heater.

2. The hair dryer of claim 1, wherein said heater is mounted on said second carrier.

3. The hair dryer of claim 1, wherein said coupling means includes said contacts.

4. The hair dryer of claim 1, wherein said coupling means includes at least one female coupling element on one of said carriers and a complementary male coupling element provided on the other of said carriers and extending into said female coupling element.

5. The hair dryer of claim 4, wherein said female coupling element includes a slot in said one carrier.

6. The hair dryer of claim 4, wherein said male coupling element comprises a lug.

7. The hair dryer of claim 4, wherein said at least one female coupling element is provided on said first carrier.

8. The hair dryer of claim 4, wherein said first carrier includes a plate having a marginal portion and said female coupling element includes at least one slot in said marginal portion.

9. The hair dryer of claim 8, wherein said male coupling element includes a lug having a bent end portion extending into said slot.

10. The hair dryer of claim 9, wherein said lug forms part of said contacts on said other carrier.

11. The hair dryer of claim 4, wherein said other carrier includes a plurality of crossing plates and the contacts on said other carrier include a metallic strip on each of said plates, each strip having a first end portion connected with said heater and a second end portion engaging a contact on said one carrier.

12. The hair dryer of claim 11, wherein said one carrier includes a discrete female coupling element for each of said strips and each female coupling element has a slot for the second end portion of the respective strip.

13. The hair dryer of claim 12, wherein said strips include the contacts on said other carrier and the contacts on said one carrier include strip-shaped conductors adjacent said recesses.

14. The hair dryer of claim 1, wherein said carriers are disposed between said motor and said outlet, said second carrier including two plates crossing each other in said housing between said outlet and said first carrier and said heater being mounted on said plates.

15. The hair dryer of claim 1 wherein said housing is elongated and one of said carriers is movable away from the other of said carriers in the longitudinal direction of said housing to thereby disengage said coupling means and to simultaneously disengage the contacts of said one carrier from the contacts of said other carrier.

* * * * *